United States Patent [19]

Weiss

[11] Patent Number: 4,848,844

[45] Date of Patent: Jul. 18, 1989

[54] OVERBURDEN EXCAVATOR

[75] Inventor: Aby Weiss, Monheim, Fed. Rep. of Germany

[73] Assignee: Mannesmann Aktiengesellschaft, Dusseldorf, Fed. Rep. of Germany

[21] Appl. No.: 76,643

[22] Filed: Jul. 23, 1987

[30] Foreign Application Priority Data

Jul. 25, 1986 [DE] Fed. Rep. of Germany ..... 3625316
Jun. 24, 1987 [DE] Fed. Rep. of Germany ..... 3721234

[51] Int. Cl.[4] ..... F21C 47/00; F21C 47/02

[52] U.S. Cl. ..... 299/55; 37/190; 198/513; 299/57

[58] Field of Search ..... 299/39, 55, 56, 57, 299/64; 198/512, 513, 518, 514; 37/189, 190, 83

[56] References Cited

U.S. PATENT DOCUMENTS

| | | | |
|---|---|---|---|
| 2,834,588 | 5/1958 | Boesewetter | 198/512 X |
| 2,851,143 | 9/1958 | Rosetz | 37/190 |
| 2,910,274 | 10/1959 | Scott | 255/19 |
| 3,038,710 | 6/1962 | Robbins | 262/9 |
| 3,043,035 | 7/1962 | Fogelberg | 37/190 |
| 3,190,697 | 6/1965 | Gonski | 198/513 X |
| 3,197,256 | 7/1965 | Hlinsky | 299/64 |
| 3,336,989 | 8/1967 | Henderson | 175/18 |
| 3,677,604 | 7/1972 | Leyrat | 299/67 |
| 3,746,100 | 7/1973 | Hall et al. | 172/40 |
| 3,901,621 | 8/1975 | Coles | 415/74 |
| 4,012,856 | 3/1977 | Schwarz | 37/187 |
| 4,017,241 | 4/1977 | Papinchak et al. | 425/237 |
| 4,046,424 | 9/1977 | Montgomery | 299/56 |
| 4,131,317 | 12/1978 | Jamison et al. | 299/57 X |
| 4,214,386 | 7/1980 | Franke | 37/190 |
| 4,454,665 | 6/1984 | Mannbro | 37/103 |
| 4,514,012 | 4/1985 | Wallace | 299/57 |
| 4,573,743 | 3/1986 | Grathoff | 299/39 |
| 4,582,436 | 4/1986 | Merron | 384/593 |
| 4,586,332 | 5/1986 | Schexnayder | 60/468 |
| 4,596,424 | 6/1986 | Wilcox, Jr. et al. | 299/64 |
| 4,601,626 | 7/1986 | Heine et al. | 414/687 |
| 4,605,118 | 8/1986 | Kotler | 37/190 X |
| 4,616,720 | 10/1986 | Kitanaka | 175/267 |
| 4,663,868 | 5/1987 | Fauerbach et al. | 37/190 |
| 4,676,014 | 6/1987 | Berchem et al. | 37/142 |

FOREIGN PATENT DOCUMENTS

| | | | |
|---|---|---|---|
| 590853 | 12/1933 | Fed. Rep. of Germany | 37/190 |
| 1139073 | 10/1962 | Fed. Rep. of Germany . | |
| 2703299 | 8/1978 | Fed. Rep. of Germany | 37/190 |
| 580471 | 10/1957 | Italy | 37/190 |

*Primary Examiner*—Jerome W. Massie, IV
*Assistant Examiner*—David J. Bagnell
*Attorney, Agent, or Firm*—Nils H. Ljungman

[57] ABSTRACT

The two ends of the luffable and swivelable arms of the gantry of an overburden excavator each have a horizontal bolt for a frame of the drive, on the axis of rotation or drive shaft of which is mounted a rotary cutter in the form of a cutter drum. The rotary cutters are disposed on both sides of a receiving conveyor. The axes of rotation of the shafts rotating the rotary cutters are oriented approximately parallel to the plane of symmetry (longitudinal axis) of the receiving conveyor belt. The angle of the rotary cutter axis can be adjusted in relation to the plane of the roadway by the length adjuster in the form of a hydraulic or pneumatic cylinder, which is located between a bearing lug of the arm and a bearing lug of the frame. The rotary cutters transport the material via transverse conveyors to the converyor belt.

23 Claims, 3 Drawing Sheets

OVERBURDEN EXCAVATOR

BACKGROUND OF THE INVENTION

1. Field of the Invention

The invention relates to an overburden excavator with a gantry arm which can be adjusted vertically and pivoted laterally, and with rotary cutters with cutting edges located on both sides of its receiving conveyor.

2. Description of the Prior Art

On an overburden excavator of the prior art as described in DE-AS 11 39 073, the axis of rotation of the rotary cutters is perpendicular to the conveyor belt, and the rotary cutters have excavating blades for the overburden, whereby the working directions of the rotary cutters can be opposite to one another. When the direction of the rotary cutters is from top to bottom, there must be extra space below the gantry for the idler rolls and the conveyor belt. If some of the material cut off remains ahead of the front end of the gantry and is not transported onto the conveyor belt, this material left on the ground hinders the movement of the rotary cutter on the other side when the gantry pivots laterally. This is also true in the opposite direction of rotation, i.e. when the rotary cutters are operating from bottom to top. This overburden excavator of the prior art is apparently suitable only for use in rather loose ground, because the overburden material is further compressed after it is removed. It is unsuited, moreover, for cutting and breaking hard rock.

OBJECT OF THE INVENTION

The object of the invention is, therefore, an overburden excavator of the type with swivelable and luffable gantry arm which makes possible the economical breaking and secure removal of even hard overburden material. This object is achieved in that the rotary cutters are disposed on both sides of a receiving conveyor so that the receiving end of this conveyor is placed between the rotary cutters, the axes of rotation of the rotary cutters being approximately parallel to the plane of symmetry of the receiving conveyor. While the gantry arm is swiveling, the rotary cutters cut and break the overburden on the outside extremity of the unit by rotation from top to bottom, and simultaneously transport it on the opposite, ascending side of the cutters toward the receiving conveyor, whereby between the rotary cutters and the receiving conveyor, there can be transverse conveyors in the form of deflector plates, or driven conveyor belts, which may also be equipped with flight feeders. To the side of the transverse conveyors and at the end of the receiving conveyor there can be deflector plates for the overburden material.

SUMMARY OF THE INVENTION

The rotary cutters are preferably cutter drums, whereby the angle between the axis of rotation of each cutter and the roadway plane can be adjusted at any time. For this purpose, a drive frame of the rotary cutter is connected with bolts to an arm of the gantry, which can have a bearing lug pointing upward for a length adjuster, which engages with a bearing lug pointing upward on the frame.

The invention relates broadly to an overburden excavator with a base and a swivelable superstructure disposed on the base. The swivelable superstructure comprises a gantry apparatus with a rotary cutter arrangement being connected to the gantry apparatus at an outer end thereof. The rotary cutter arrangement has axes about which the cutting action of the rotary cutter arrangement cuts. The rotary cutter arrangement also has transverse conveyors disposed on the gantry behind the rotary cutters transferring material cut thereby from the rotary cutter arrangement to a receiving conveyor disposed on the gantry between the rotary cutters. The receiving conveyor transporting material to a location on the superstructure inwardly thereof defines a longitudinal axis or plane of symmetry disposed along the gantry. The shafts for driving the rotary cutters are disposed along the gantry on both sides of the receiving conveyor, and each shaft defines its own longitudinal axis. The longitudinal axes of the shafts are disposed substantially parallel to the longitudinal plane of symmetry of the receiving conveyor. The inclination of the shafts can be adjusted by a length adjuster.

Embodiments of the invention are illustrated in the accompanying drawings and are explained in greater detail below.

DESCRIPTION OF THE PREFERRED EMBODIMENTS

Figure 1:
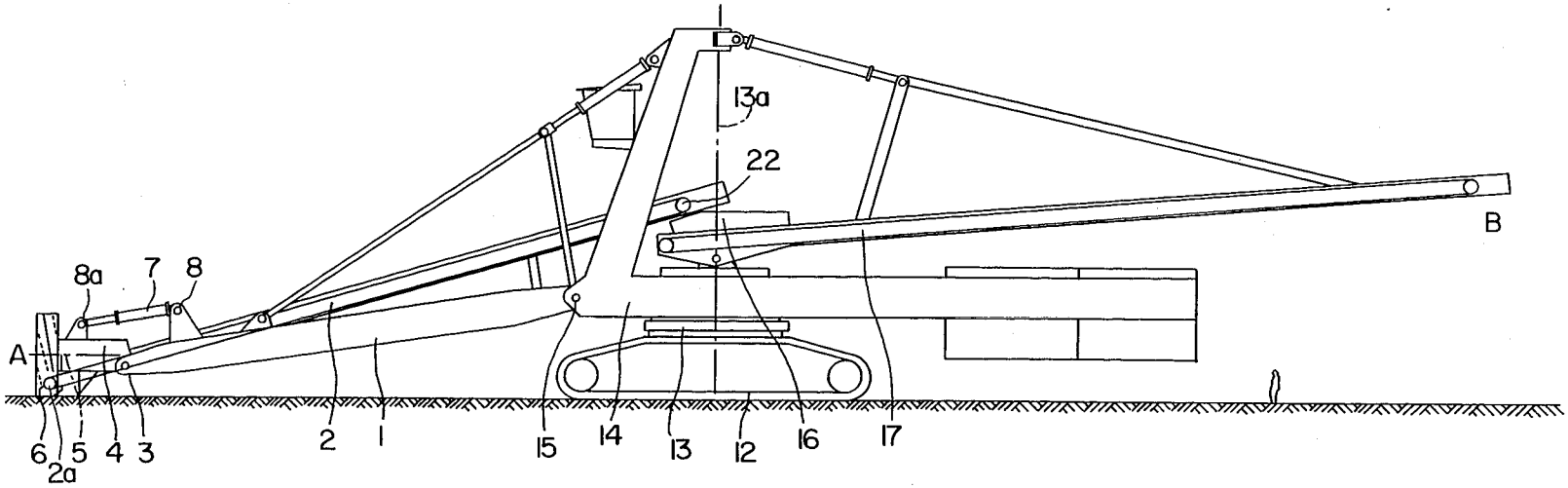
FIG. 1 shows a lateral view of an overburden excavator.

The overburden excavator has a caterpillar track 12 with a rim 13 for the swivelable superstructure 14, on which the arms 1 of a vertically movable gantry are mounted by means of bolts 15. Between the arms 1 of the gantry there is a receiving conveyor 2, which transports the material broken at the excavating face A via a discharge funnel 16 onto the conveyor belt 17 to the discharge point B.

Figure 3:
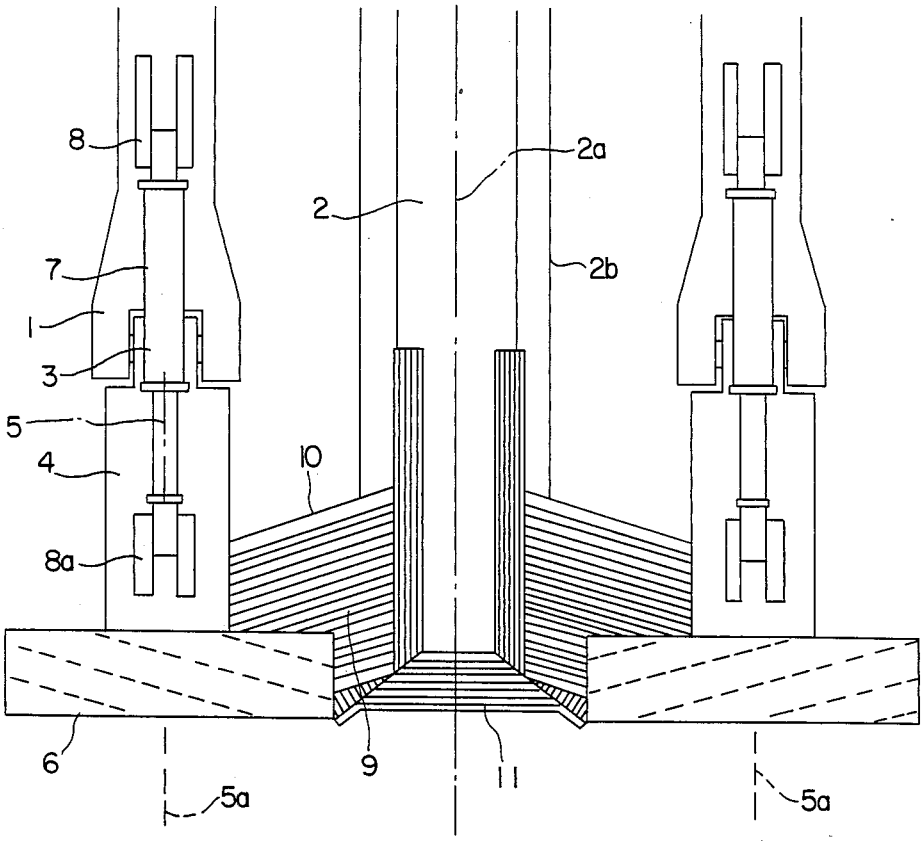
FIG. 3 shows the rotary cutters and associated equipment in FIG. 2 on an enlarged scale.

The ends of the arms 1 of the gantry each have horizontal bolts 3 for a frame 4 of a drive, on whose axis of rotation 5*a* of the drive shaft 5 is mounted a cutter in the form of a cutting drum. The rotary cutters 6 are disposed laterally on both sides of the receiving end of the receiving conveyor 2. The axes of rotation 5*a* of the rotary cutters 6 are approximately parallel to the plane of symmetry (longitudinal center plane 2*a*) of the conveyor belt 2. Instead of two cutting drums, other breaking and/or transport devices equipped with teeth or cutting edges can also be used. The angle of each frame 4 with the rotary cutter 6 can be adjusted in relation to the roadway plane by means of a length adjuster 7 (shown in FIG. 3) in the form of a hydraulic, or pneumatic, cylinder which is located between a bearing lug 8 of the arm 1 and a bearing lug 8*a* of the frame 4. The rotary cutter transports the material via a transverse conveyor 9 with a chute 9*a* visible in FIG. 4 onto the conveyor belt 2. The transverse conveyor 9 is disposed substantially tangential to the swiveling motion of the gantry 1 around the axis 13*a* of the rim 13 and is preferably a deflector in the manner of a plough blade. To transport the material, the rotation of the rotary cutter 6 equipped with the cutting edges in the direction of the arrow indicated in FIG. 4 generally suffices, in combination with the swiveling motion of the gantry around the axis 13*a* of the rim 13. The material is prevented from sliding off the transverse conveyor 9 by a deflector 10 located approximately vertically behind it, and by a plate 11 located ahead of the front end of the conveyor belt 2 over the idler roller 20 of the conveyor belt 2. Instead of a plough blade driven belt conveyors or flight feeders can also be used as transverse conveyors (FIG. 3).

Figure 2:
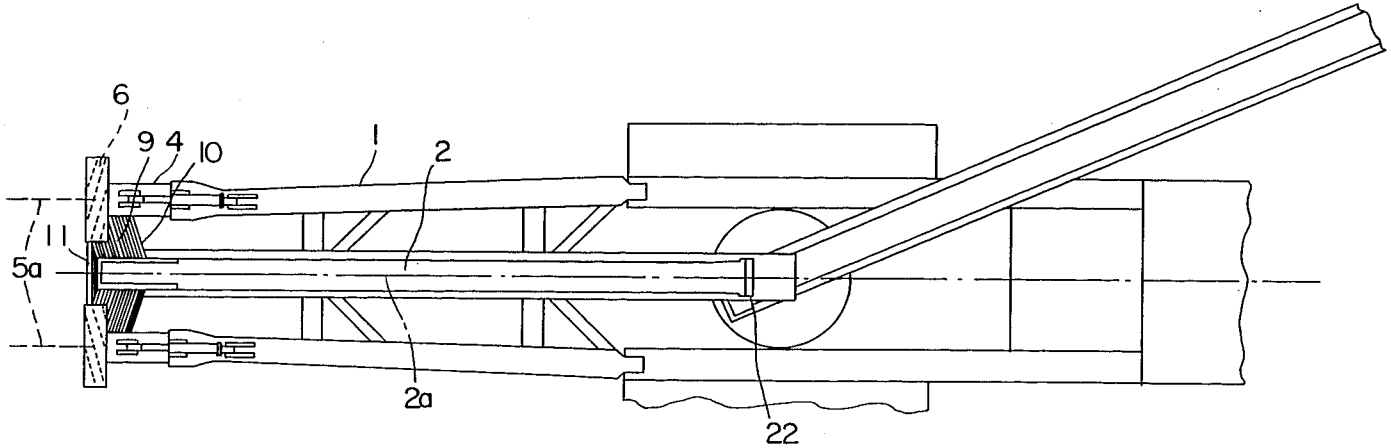
FIG. 2 shows an overhead view of an embodiment illustrated in FIG. 1.

Referring once again to FIG. 2, the axis of rotation 5*a* of the drive shaft 5 which runs the rotary cutter 6 is approximately parallel to the longitudinal center plane 2*a* of the conveyor belt. The details of the drive which rotates the rotary cutter 6 are not shown in detail in the figures but are well known in the prior art and are typically shown in U.S. Pat. No. 4,616,720, entitled, "Divided Bucket Type Rotary Excavator", U.S. Pat. No. 4,663,868, entitled "Scoop Wheel Having Oscillating Impact Cutters"; U.S. Pat. Nos. 3,677,604; 3,746,100; 4,012,856; 4,214,386; 2,910,274; 3,038,710; and 3,336,989. All of the afore-mentioned patents are incorporated by reference as if the entire contents thereof were fully set forth herein.

Figure 4:
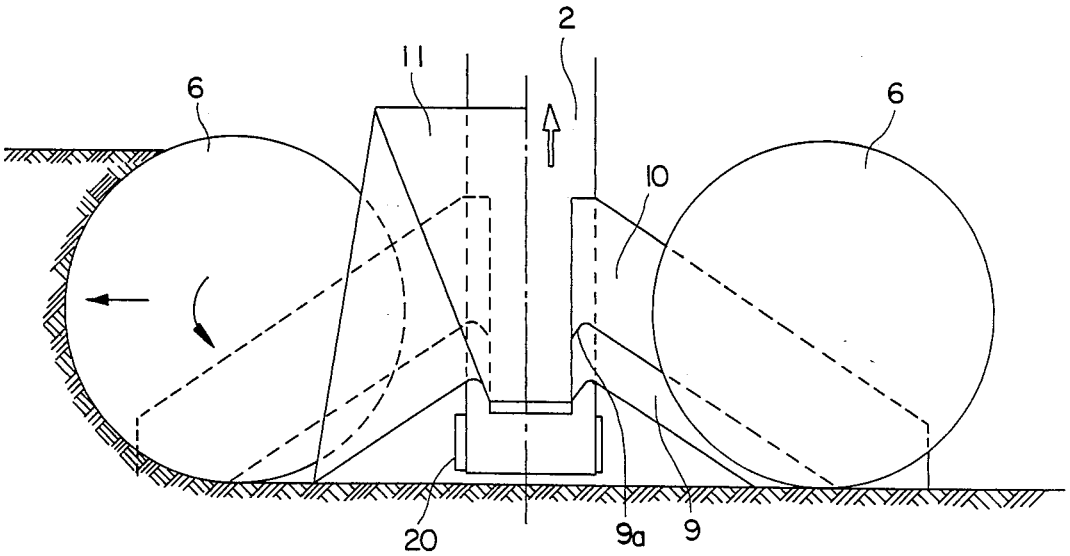
FIG. 4 shows a head-on view of the embodiment illustrated in FIG. 3.

The conveyor belt 2 is supported by a structure 2*b* which, among other things, maintains the conveyor belt 2 in a stretched position between the two rollers 20 and 22, as shown in FIG. 4 and FIG. 1 respectively.

Referring once again to FIG. 4, the transverse conveyor 9 and the chutes 9*a* are all attached to the supporting structure 2*b* of the conveyor belt 2. The conveyor belt 2 may be termed as a receiving conveyor, since it receives material excavated by the cutters 6 which is transported by the transverse conveyors 9 and into the chutes 9*a* for loading onto the conveyor belt 2. The supporting mechanism for the transverse conveyors 9 and the chutes 9*a* is not shown in any detail but can be any of a number of means of attachments such as rods, I-beams and plates for providing substantially high rigidity. Each chute 9*a* is preferably also attached to a similar structure or the same structure that supports its transverse conveyor 9. The plate 11 located ahead of the front end of the conveyor belt 2 is shown on the left side in FIG. 4 and is omitted on the right side thereof for simplicity. This plate 11 extends adjacent the transverse conveyor 9 and the chute 9*a* in order to guide the material which has been excavated by the cutters 6 and conveyed by the transverse conveyor 9. This plate 11 is also attached, preferably, by means of a structure not shown, to the structure 2*b* which supports the conveyor belt 2. This not shown structure is similar to that as described above for holding the transverse conveyors 9 and the chutes 9*a*.

In summing up, the overburden excavator of an embodiment of the present invention has a gantry which can move vertically and pivot laterally. The lateral pivoting of the gantry is preferably done about the swiveling axis 13*a* of the superstructure 14 of the excavator. In relationship to the gantry, there is a structure 2*b* for holding the conveyor belt 2 thereon. On both sides of the gantry there are rotary cutters 6 located on both sides of the receiving end of the receiving conveyor belt 2. The rotary cutters 6 are driven by shafts 5 which are substantially parallel to the longitudinal center plane 2*a* of the conveyor belt 2.

Behind each of the rotary cutters 6 at least a portion of a transverse conveyor 9 is disposed substantially tangential to the swiveling motion of the gantry 1 around the axis 13*a* of the rim 13. A portion of each of the transverse conveyors 9 is disposed between the cutters 6. The transverse conveyors 9 preferably end over the conveyor belt 2 and transport the material cut by the rotary cutter 6 across to the conveyor belt 2.

Each of these transverse conveyors 9 has a deflection plate 9*a* disposed for guiding the material excavated by the cutters 6 onto the main, or receiving, conveyor belt 2. These transverse conveyors 9 can be of deflector type or driven as belt conveyors or chain driven flight feeders.

The transverse conveyors 9 may be driven by hydraulic motors supplied by hydraulic pressure from a motor (not shown). This motor is preferably disposed in the superstructure 14 and drives also the conveyor belt 2 and the axles 5, which drive the cutters 6. Alternatively, other means of driving the particular belts and shafts may be used, such as an individual transmissions or motors for driving each of the following, that is, the main conveyor belt 2, the transverse conveyor belt 9, and the shafts 5 for rotating cutters 6. Alternatively, there could be a transmission driving the shafts 5 for reversing the rotation of the rotary cutters 6 for under certain conditions.

Figure 5:
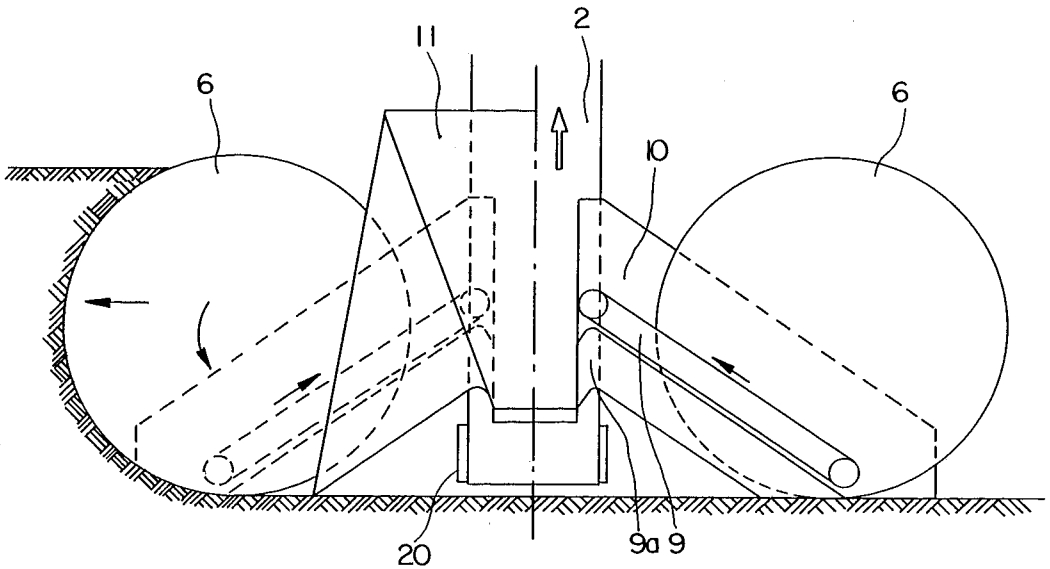
FIG. 5 shows an embodiment of the general concept illustrated in FIG. 4, in an alternative, with driven transverse conveyors.

The transverse conveyors 9 in an embodiment of the invention are equipped with chain or flight feeders as shown in FIG. 5. Flight feeders are described in U.S. Pat. No. 4,017,241, entitled "Notched Flight Feeder Screws for Briquetting Operation" and U.S. Pat. No. 3,901,621, entitled "Auger Assembly". Each of the afore-mentioned patents is incorporated by reference as if the entire contents thereof were fully set forth herein.

Each frame 4 is adjusted by the preferably hydraulic, or pneumatic, cylinder which comprises the length adjuster 7, as shown in FIGS. 1 and 3. In this embodiment of the invention, the angle of the shaft 5 which drives the cutter 6 can be adjusted with respect to the ground plane.

The frame 4 of the rotary cutter 6 is attached with bolts 3 to the arm of the gantry. The arm of the gantry has a bearing lug 8 pointing upwardly for the attachment of a length adjuster 7, which length adjuster engages a bearing lug 8 pointing upwardly from the frame 4. FIG. 5 shows an embodiment of the general concept illustrated in FIG. 4, in an alternative, with driven transverse conveyors.

The invention as described hereinabove in the context of the preferred embodiments is not to be taken as limited to all of the provided details thereof, since modifications and variations thereof may be made without departing from the spirit and scope of the invention.

I claim:

1. An overburden excavator with a base and a swivelable and luffable superstructure disposed on said base;

said base having means for moving said overburden excavator along the ground;

said swivelable superstructure having a swivel axis about which the swiveling motion occurs with respect to said base;

said swivelable superstructure comprising gantry means which swivels with said superstructure;

said gantry means extending beyond a portion of said swivelable superstructure disposed above said base;

rotary cutter means being connected to said gantry means at an outer end thereof;

said rotary cutter means having axes about which the cutting action of said rotary cutter means cut;

a receiving conveyor being disposed on said gantry for receiving and transporting material cut by said rotary cutter means from said rotary cutter means to a location on said swivelable superstructure inwardly of said rotary cutter means;

said receiving conveyor having a receiving end opposite to the swivel axis of said swivelable superstructure;

said receiving end of said receiving conveyor being placed between said rotary cutter means;

said receiving conveyor defining a longitudinal central plane of symmetry disposed along said gantry;

shafts for driving said rotary cutter means;

said shafts being disposed along a portion of said gantry;

each said shaft defining its own longitudinal axis;

the vertical plane of the longitudinal axes of said shafts being disposed substantially parallel to said longitudinal plane of symmetry of said receiving conveyor; and said axes of said rotary cutter means being disposed substantially parallel to said longitudinal plane of symmetry of said receiving conveyor.

2. The overburden excavator according to claim 1, including transverse conveyor means being disposed behind said rotary cutter means;

said transverse conveyor means being disposed substantially transverse to said receiving conveyor along the swivelable motion of said gantry means around said swivel axis of the superstructure for transporting material cut by said rotary cutter means across to said receiving conveyor.

3. The overburden excavator according to claim 2, wherein said rotary cutter means comprises two rotary cutters, one of said rotary cutters being disposed on one side of said receiving conveyor and the other of said rotary cutters being disposed on the other side of said conveyor opposite said one side.

4. The overburden excavator according to claim 3, wherein said rotary cutter means comprise cutting drum means.

5. The overburden excavator according to claim 2, wherein said transverse conveyor means extend over said receiveing conveyor.

6. The overburden excavator according to claim 5, wherein said transverse conveyor means are drive belt conveyors.

7. The overburden excavator according to claim 5, wherein said transverse conveyor means comprise flight feeders.

8. The overburden excavator according to claim 5, wherein substantially vertical deflector plates are disposed along the said transverse conveyor means on the side opposite to said rotary cutter means.

9. The overburden excavator according to claim 2, wherein the transverse conveyor means have deflector plates disposed behind said rotary cutter means.

10. The overburden excavator according to claim 2, wherein said transverse conveyor means are driven belt conveyors.

11. The overburden excavator according to claim 2, wherein said transverse conveyor means comprise flight feeders.

12. The overburden excavator according to claim 2, wherein substantially vertical deflector plates are disposed along the said transverse conveyor means on the side opposite to said rotary cutter means.

13. The overburden excavator according to claim 2, wherein said gantry comprises frame means; and each said rotary cutter is attached to said frame means; each said frame being pivotally connected to said gantry means.

14. The overburden excavator according to claim 1, wherein said rotary cutter means comprises two rotary cutters, one of said rotary cutters being disposed on one side of said receiving conveyor and the other of said rotary cutters being disposed on the other side of said conveyor opposite said one side.

15. The overburden excavator according to claim 14, wherein said rotary cutter means comprise cutting drum means.

16. The overburden excavator according to claim 1, including a deflector plate disposed between the said rotary cutter means at the end of the receiving conveyor which is opposite said swiveling axis of the said swiveling superstructure.

17. The overburden excavator according to claim 1, wherein said shafts for driving said rotary cutter means include means for changing the angle of an end thereof adjacent its each of the rotary cutter means with respect to the roadway plane.

18. The overburden excavator according to claim 1, wherein said gantry comprises frame means; and each said rotary cutter is attached to said frame means;

each said frame being pivotally connected to said gantry means.

19. The overburden excavator according to claim 18, wherein said gantry means has arm means extending along both sides of said receiving conveyor;

position adjusting means for adjusting the position of each said frame means angularly with respect to each said arm means, said arm means being attached to said frame means.

20. The overburden excavator according to claim 19, wherein said position adjusting means includes pivotal bolts for attachment of said position adjusting means to said frame means and said arm means.

21. The overburden excavator according to claim 20, wherein said position adjusting means includes bearing lug means attached to said frame means, said bearing lug means point upwardly from said frame means.

22. The overburden excavator according to claim 21, wherein at least some of said pivotal bolts are disposed in said bearing lug means.

23. An overburden excavator with a base and a superstructure disposed on said base;

said base having means for transporting said overburden excavator along the ground;

said superstructure comprising gantry means;

said gantry means extending beyond a portion of said superstructure immediately above said base;

a plurality of rotary cutter means being connected to said gantry means at an outer end thereof;

said rotary cutter means having axes about which the cutting action of said rotary cutter means cut;

a receiving conveyor being disposed on said gantry for receiving and transporting material cut by said rotary cutter means from said rotary cutter means to a location on said superstructure inwardly of said rotary cutter means;

said receiving conveyor having a receiving end extending from said portion of said superstructure immediately above said base;

said receiving end of said receiving conveyor being placed between said rotary cutter means;

said receiving conveyor defining a longitudinal axis disposed along said gantry;

shafts for driving said rotary cutter means;

said shafts being disposed along a length of said gantry;

each said shaft defining its own longitudinal axis;

the vertical plane of the longitudinal axes of said shafts being disposed substantially parallel to said longitudinal plane of symmetry of said receiving conveyor; and said axes of said rotary cutter being disposed substantially parallel to said longitudinal plane of symmetry of said receiving conveyor.

* * * * *